US005816628A

United States Patent [19]

Götzen et al.

[11] Patent Number: 5,816,628

[45] Date of Patent: Oct. 6, 1998

[54] MOTOR-VEHICLE TRUNK-LATCH SYSTEM

[75] Inventors: Klaus Götzen, Mühlheim; Thorsten Torkowski, Duisburg, both of Germany

[73] Assignee: Kiekert AG, Heiligenhaus, Germany

[21] Appl. No.: 679,684

[22] Filed: Jul. 11, 1996

[30] Foreign Application Priority Data

Jul. 29, 1995 [DE] Germany ..... 195 27 835.6

[51] Int. Cl.[6] ..... E05C 3/16

[52] U.S. Cl. ..... 292/216; 292/DIG. 43; 292/DIG. 72

[58] Field of Search ..... 292/216, DIG. 23, 292/DIG. 27, 336.3, DIG. 72, DIG. 43

[56] References Cited

U.S. PATENT DOCUMENTS

| | | | |
|---|---|---|---|
| 4,652,027 | 3/1987 | Quantz | 292/201 |
| 4,796,932 | 1/1989 | Tame | 292/DIG. 43 |
| 4,961,601 | 10/1990 | Lindholm et al. | 292/DIG. 72 |
| 4,962,955 | 10/1990 | Ferrara et al. | 292/216 |
| 4,968,073 | 11/1990 | Kuhlman | 292/216 |
| 4,969,672 | 11/1990 | Childs et al. | 292/216 |
| 5,020,838 | 6/1991 | Fukumoto | 292/DIG. 43 |

FOREIGN PATENT DOCUMENTS 4322689 1/1994 Germany .

*Primary Examiner*—Rodney M. Lindsey
*Attorney, Agent, or Firm*—Herbert Dubno; Andrew Wilford

[57] ABSTRACT

A latch system usable with a motor-vehicle trunk lid that is movable between an open position and a closed position has a latch engageable with the lid and having a control element movable between a latched position in which the latch retains the lid in the closed position and an unlatched position in which it allows the lid to move from the closed to the open position and a pusher engageable with the lid and displaceable between a down position with the lid in the closed position and an up position forcing the lid into the open position. A drive motor has an output engageable with the control element and the pusher and displaceable through a first position moving the control element into the unlatched position and a second position moving the pusher into the up position. A remotely operable controller operates the drive motor and displaces its output sequentially through the first and second positions.

10 Claims, 7 Drawing Sheets

MOTOR-VEHICLE TRUNK-LATCH SYSTEM

FIELD OF THE INVENTION

The present invention relates to a motor vehicle with a remotely actuatable trunk latch. More particularly this invention concerns a trunk-latch system which allows for remote unlatching and opening of the motor-vehicle trunk.

BACKGROUND OF THE INVENTION

In order to make it easier to load and unload a trunk, it is standard to provide it with a remotely operable latch that can be tripped, for instance by a remote control, to unlatch and even open the trunk lid. Thus a person carrying packages can trip the latch so that not only is the latch unlatched, but the trunk is actually opened a few inches so it can easily be raised the rest of the way even by someone whose hands are full. Thus the user can easily lift it farther up, as such lids are invariably spring loaded so they can be raised easily, and set the packages inside.

Such systems are normally quite simple in that they have a short-stroke spring braced between the vehicle body and the trunk lid. Thus once the latch opens, the spring pops the lid up enough to make its further opening very easy.

The disadvantage of this system is that the trunk often stays closed. The seals around the lid can stick together with enough force that the spring cannot break the lid free, particularly in cold weather when water has frozen in the joint. Furthermore if snow or ice is on the lid, the spring often does not have enough force to raise this extra weight and the lid stays down.

OBJECTS OF THE INVENTION

It is therefore an object of the present invention to provide an improved motor-vehicle trunk-latch system.

Another object is the provision of such an improved motor-vehicle trunk-latch system which overcomes the above-given disadvantages, that is which opens the trunk lid under virtually any circumstances, for instance when a substantial amount of snow or ice is sitting atop the lid.

SUMMARY OF THE INVENTION

A latch system usable with a motor-vehicle trunk lid that is movable between an open position and a closed position has according to the invention a latch engageable with the lid and having a control element movable between a latched position in which the latch retains the lid in the closed position and an unlatched position in which it allows the lid to move from the closed to the open position and a pusher engageable with the lid and displaceable between a down position with the lid in the closed position and an up position forcing the lid into the open position. A drive motor has an output engageable with the control element and the pusher and displaceable through a first position moving the control element into the unlatched position and a second position moving the pusher into the up position. A remotely operable controller operates the drive motor and displaces its output sequentially through the first and second positions.

Thus the instant invention uses the motor that is provided in any case to release the latch for actually raising the trunk lid. Thus if it is stuck or covered with snow, this motor can exert sufficient force to lift it. A particular advantage of this is that it avoids the problem of the lid suddenly popping open because on a previous actuation it had stuck shut so that all that was holding it down was some snow or a sticky seal. According to this invention the lid is positively raised by the already provided motor so that the additional function can be added without appreciably increasing the cost of the latch system.

In accordance with this invention the motor output is a cam rotatable about an axis and having a cam formation engageable with the latch control element and with the pusher. The pusher is coupled to the lid such that when the lid is returned to the closed position the pusher is moved back to the down position. In addition the first and second positions are angularly offset by about 90° from each other. More particularly the pusher includes an abutment engageable in the up position of the pusher with the cam to prevent its rotation past a third position angularly offset from the first and second positions. The abutment is clear of the cam in the down position of the pusher. Thus when the trunk lid is raised the abutment is positioned to stop the cam in a starting position from which it can only move when the trunk is closed. A return spring is provided to urge the latch-control element into the latched position and a catch is provided to releasably hold the pusher in the up position.

In accordance with another feature of the invention the cam is provided with a first cam formation engageable with the latch control element and a separate second cam formation engageable with the pusher. The cam is a disk having one face carrying the first formation and an opposite face carrying the second formation. The first formation has a generally radially extending starting portion and a following portion of generally part-circular shape centered on the axis and the second formation is generally spiral shaped and is angularly set relative to the first formation so as to raise the pusher into the up position only after the latch control element has been moved to the unlatched position.

The motor can have an output shaft carrying the cam so that the motor and cam are coaxial or a transmission can be provided between the motor and the cam.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
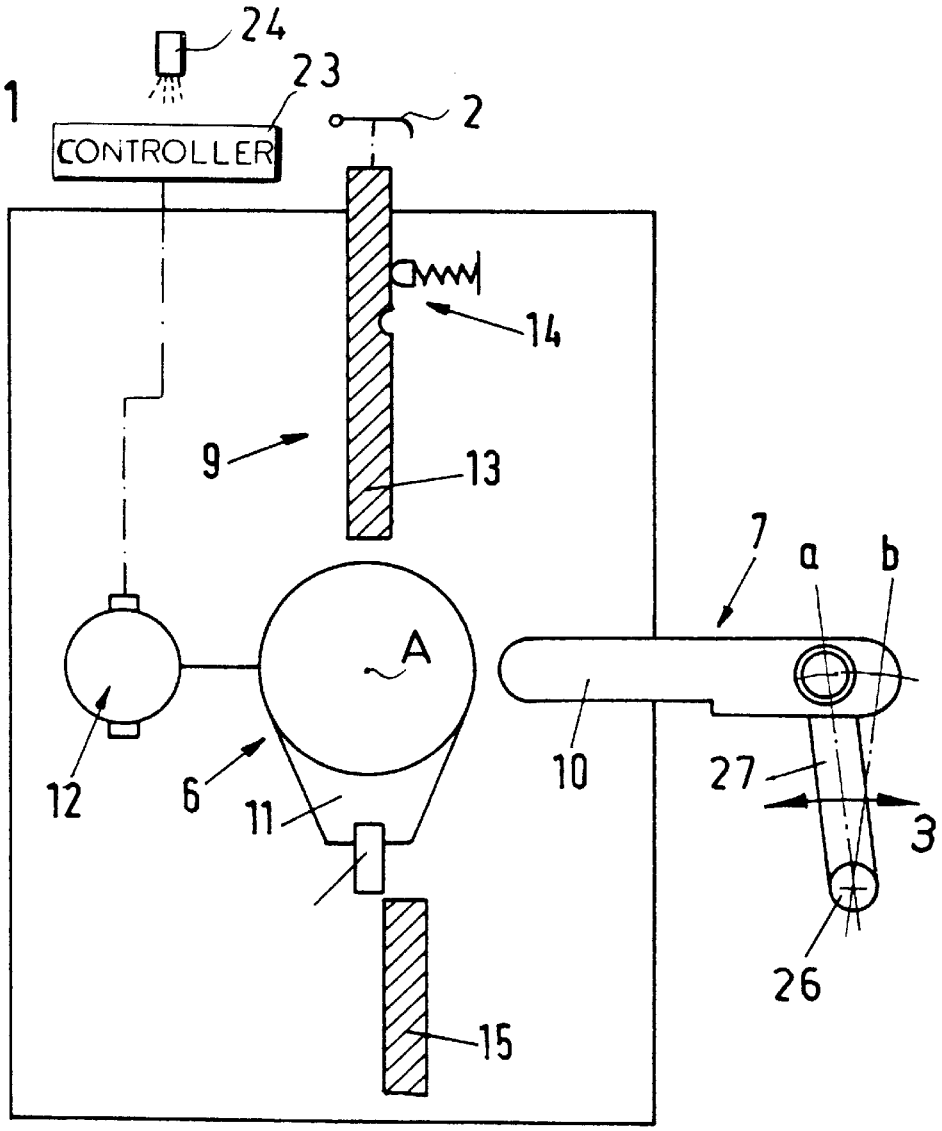
FIG. 1 is a largely schematic view of the system of this invention with the trunk latch latched and the trunk lid closed.
Figure 1A:
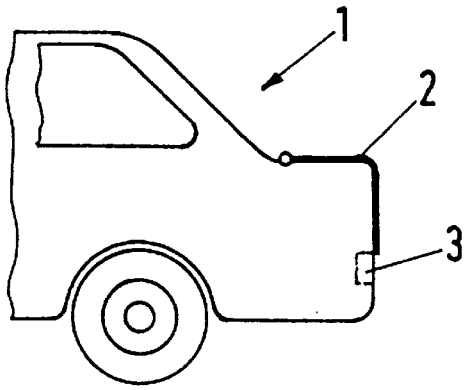
FIG. 1*a* is a view like FIG. 1 showing the rear end of the vehicle with the parts in the position of FIG. 1.
Figure 5:
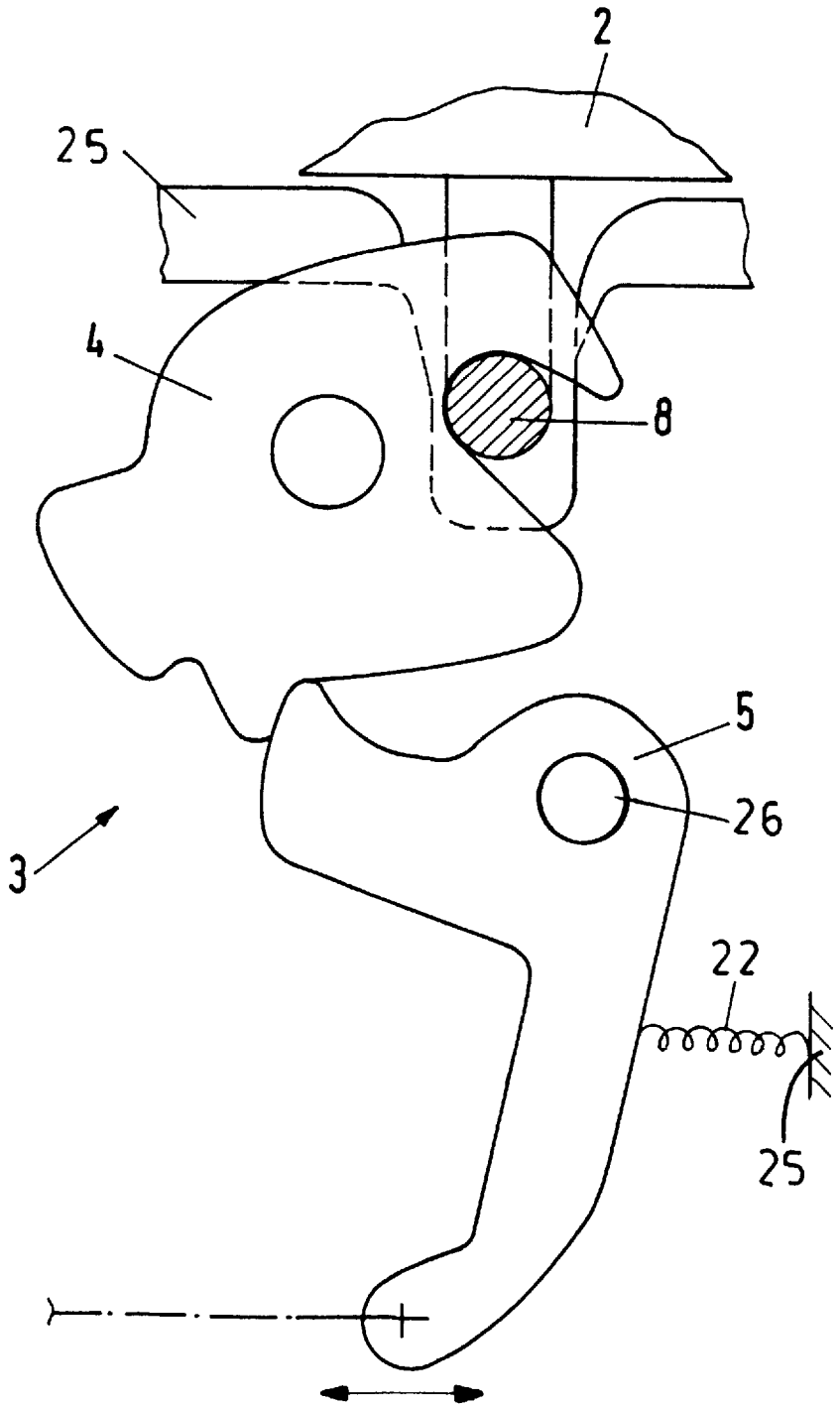
FIG. 5 is a large-scale view of a detail of the latch of the inventive system.

As seen in FIGS. 1 and 1*a* a motor-vehicle 1 according to the invention has a trunk lid 2 that can be secured in the illustrated closed position by a latch 3. This latch 3 as shown in FIG. 5 comprises a pivotal fork 4 carried on a body 25 of the vehicle 1 and engageable around a standard bolt 8 forming part of an eye carried on the lid 2. A pawl 5 normally holds the fork 4 in the illustrated latched position engaged around the bolt but can be pivoted against the force of a spring 22 braced against the body 25 to free this fork 4 and allow the bolt 8 to move out of the fork 4, freeing the lid 2 to open. The pawl 5 is fixed on a shaft 26 to which is also fixed a radially extending link arm 27 on which is pivoted an actuator element 7 so that pivoting of this element 7 between positions shown at a and b in FIG. 1 moves the latch 3 between the latched and unlatched positions, respectively. In addition an unillustrated bowden cable and/or key cylinder can directly act on the pawl 5 to manually unlatch the latch 3.

The trunk lid 2 rests on a pusher element 9 having an upper part 13 and a lower part 15 that are fixed relative to each other and that can move vertically through a limited stroke. An actuator 6 rotatable about an axis A between the parts 13 and 15 has a cam 11 and is operated by a coaxial drive motor 12 here shown laterally offset. A controller 23 capable of operation by a remote actuator 24 operates the drive motor 12, normally rotating it through about 360° for each actuation of the remote 24.

The cam 11 can engage and displace the element 7 between its latched position a and unlatched position b, and can also engage and lift the element 9 which can be retained in a lifted position by a spring-loaded catch 14. An axially projecting tab 27 can engage the lower part 15 in the raised position of the pusher 9.

This system operates as follows:

To start with as shown in FIGS. 1 and 1*a* the trunk 2 is closed, the latch 3 is latched, and the cam 11 is positioned with its tab 27 and lobe directed down, at the part 15. When the remote 24 is operated the controller 23 starts the motor 12 to rotate the cam 11 counterclockwise.

Figure 2:
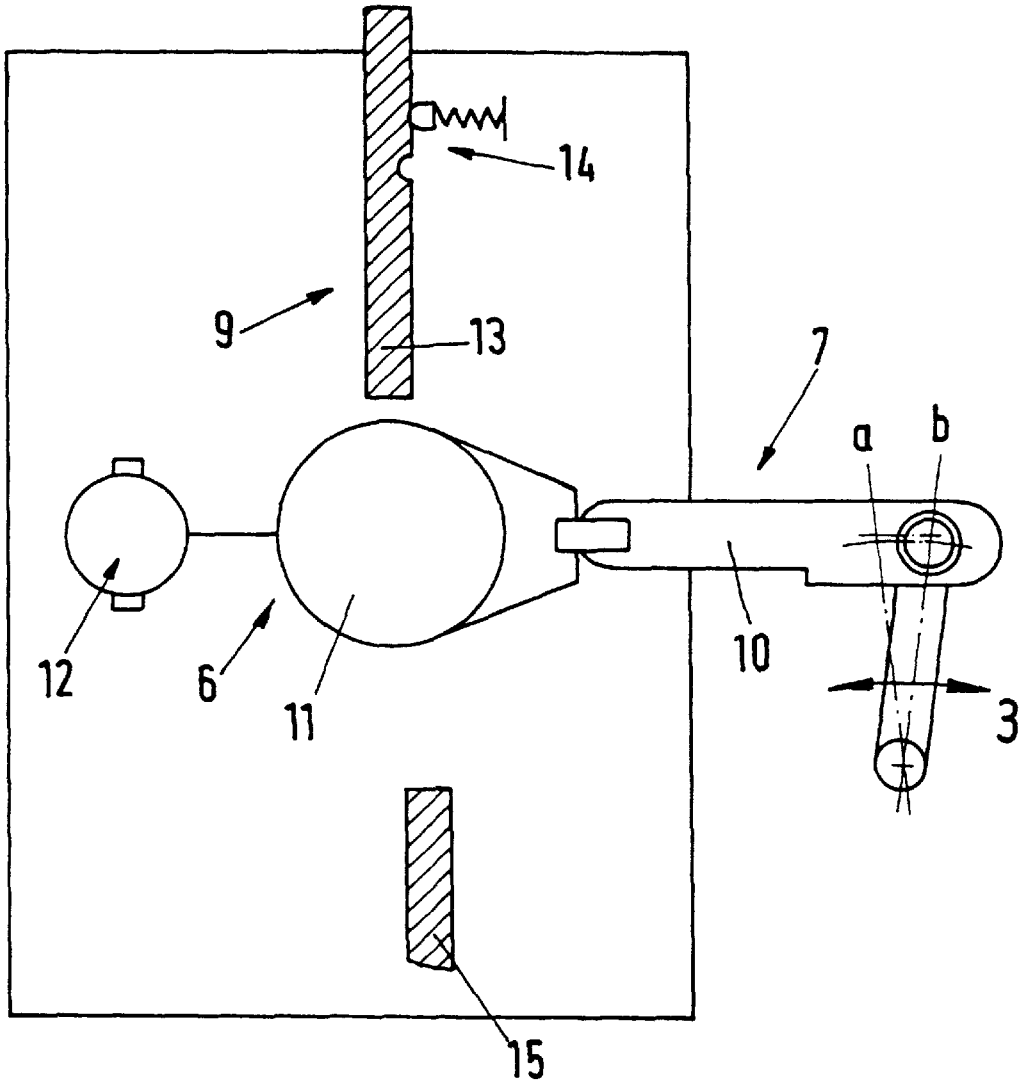
FIGS. 2 and 2*a* are views like respective FIGS. 1 and 1*a* but showing the system with the latch unlatched and the lid closed.
Figure 2A:
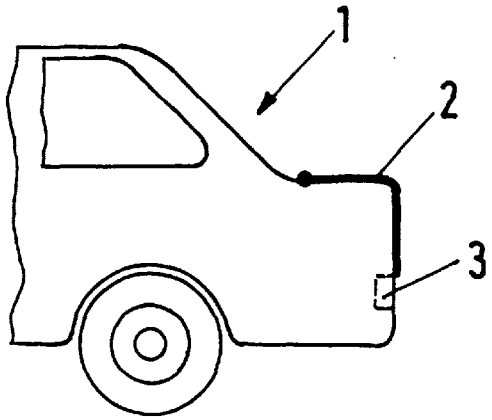

After moving through 90° as shown in FIG. 2, the cam 11 engages the element 7 and moves it from the latched position a to the unlatched position b, thereby releasing the pawl 5 from the fork 4 so that the bolt 8 can pull out of the fork 4. The lid 2 remains closed as indicated by FIG. 2*a* but normally the fork 4 moves sufficiently that even when the pawl 5 is released it does not retain the fork 4 in the latched position.

Figure 3:
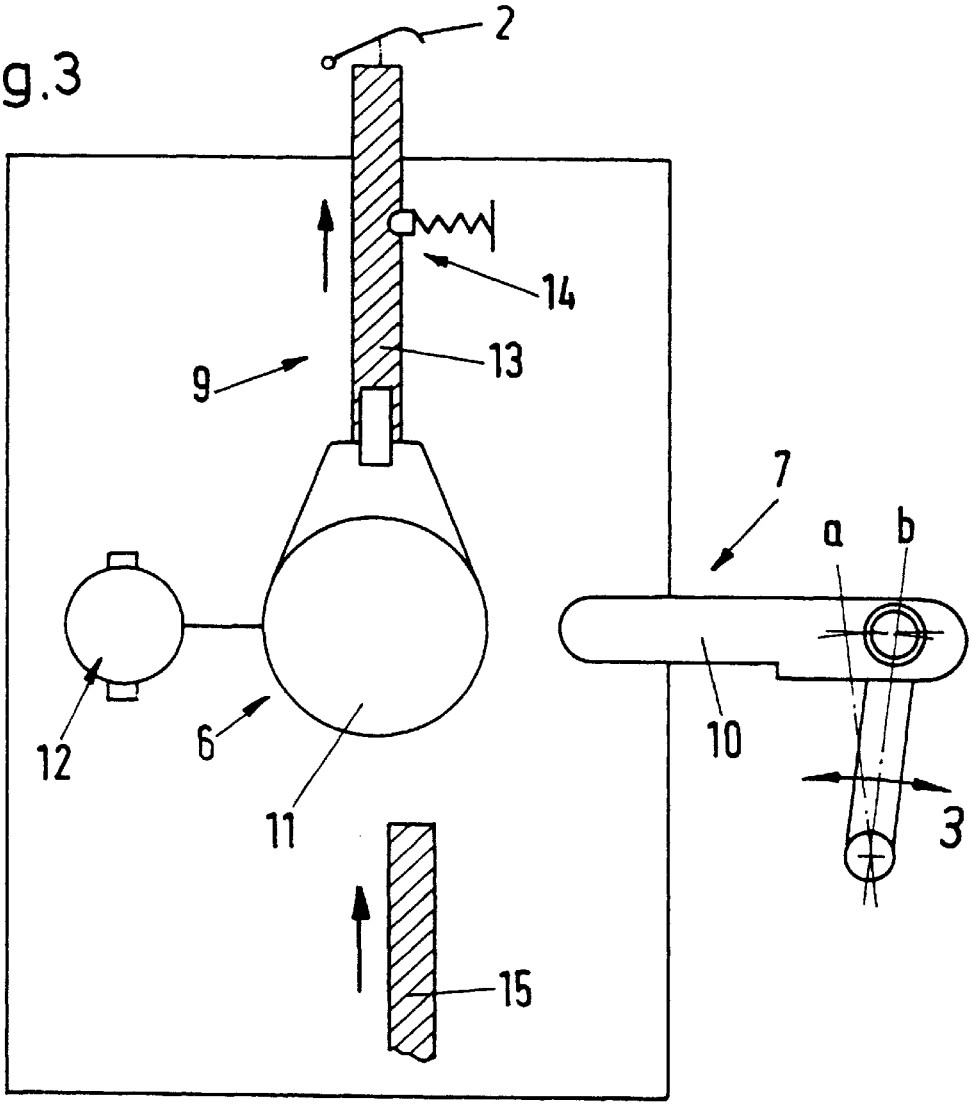
FIGS. 3 and 3*a* are views like respective FIGS. 1 and 1*a* but showing the system with the latch unlatched and the lid held open.
Figure 3A:
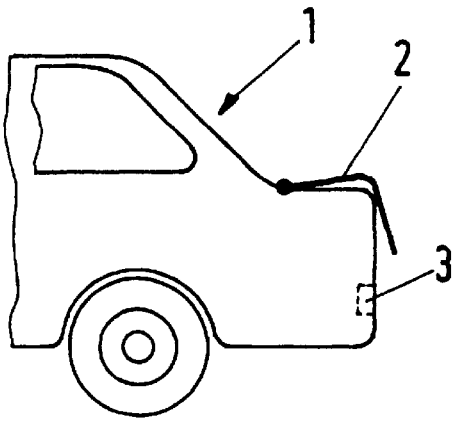

The cam 11 continues to rotate and after moving through another 90° it engages and lifts the pusher 9 by engaging its upper part 13 as shown by FIG. 3. This lifts the trunk lid 2 about 20 cm so that it is easy for the user to raise completely. The catch 14 retains the lid 2 in the raised position by engaging its spring-loaded end in a notch in the upper part 13.

Figure 4:
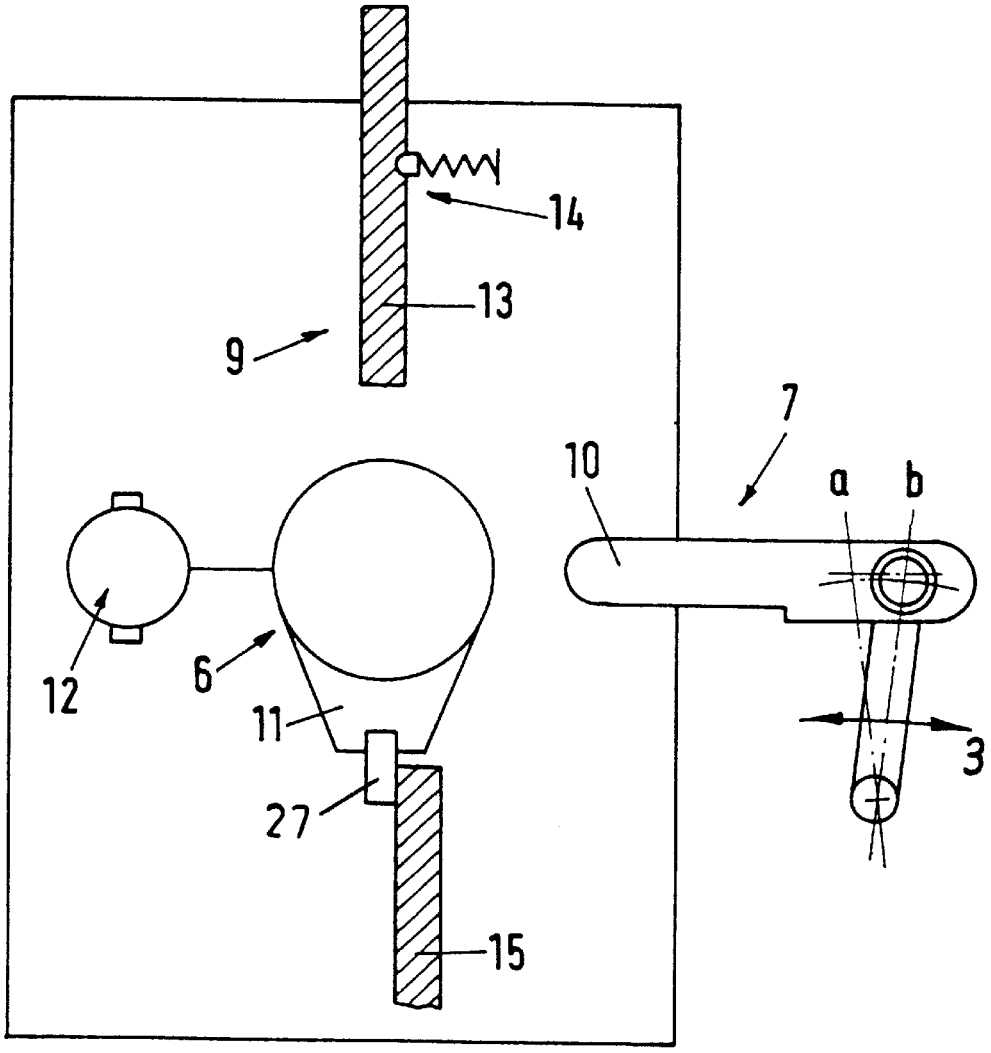
FIGS. 4 and 4*a* are views like respective FIGS. 1 and 1*a* but showing the system with the latch unlatched and the lid open but closable.
Figure 4A:
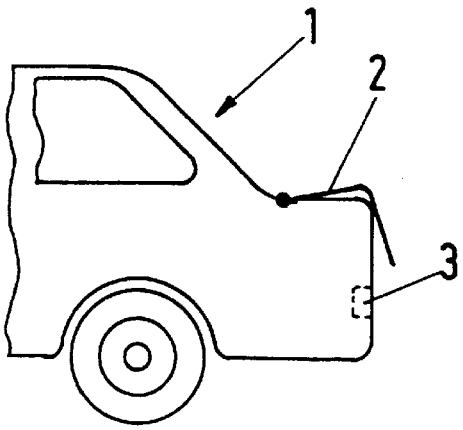

Meanwhile the motor 12 continues to rotate and, after moving through another 180°, its tab 27 engages the raised lower part 15 as shown by FIG. 4, and the motor 12 automatically shuts off. The lid 2 stays up as indicated by FIG. 4*a*.

When the lid is subsequently closed, the pusher 9 is moved down, clearing the lower part 15 out of the path of the tab 27 and pushing the latch back into the latched position a. Thus the mechanism is returned to the position of FIG. 1, ready for another actuation.

Figure 6:
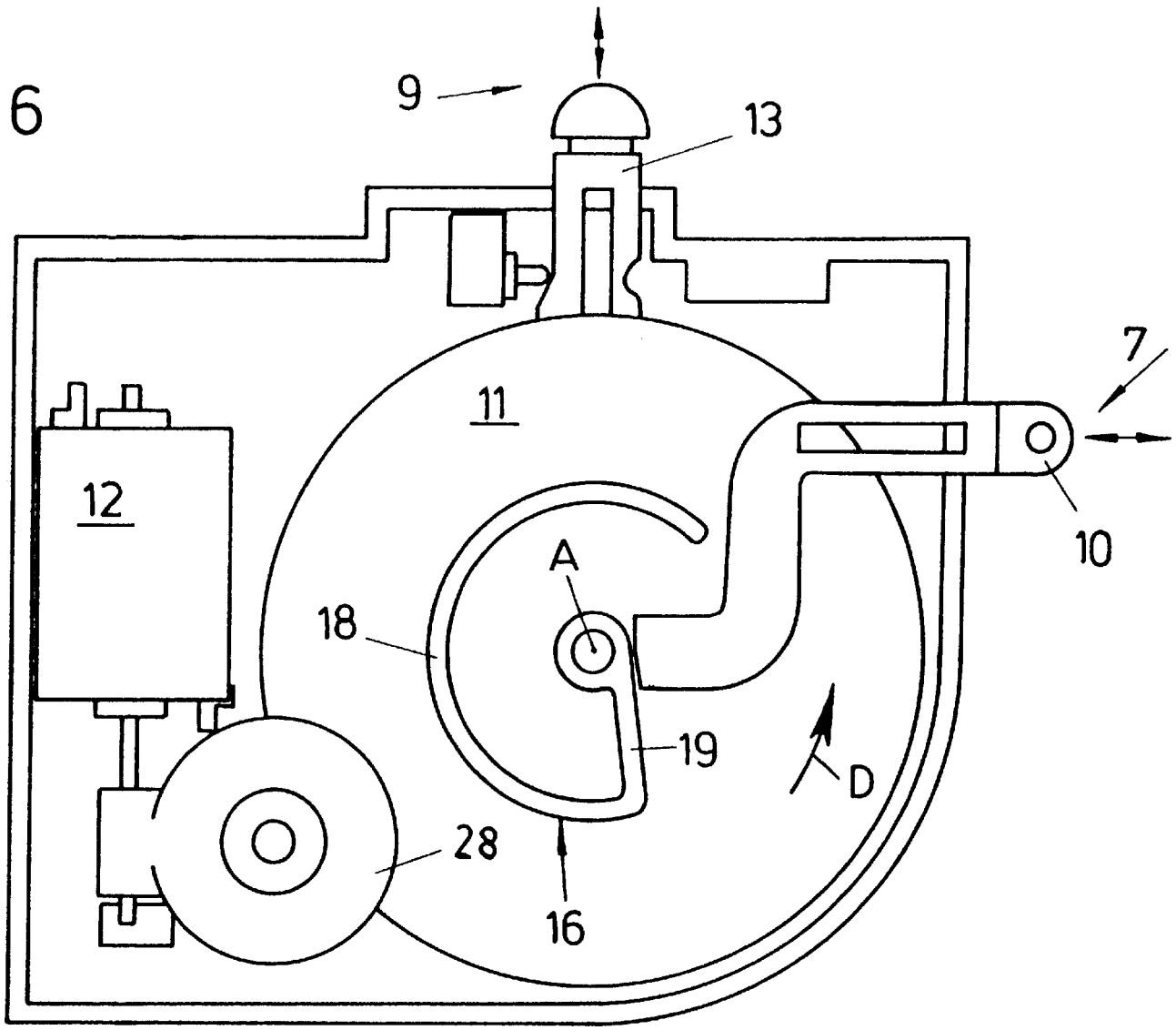
FIGS. 6 and 7 are front and back views of elements of an alternative actuator for the latch system of this invention.
Figure 7:
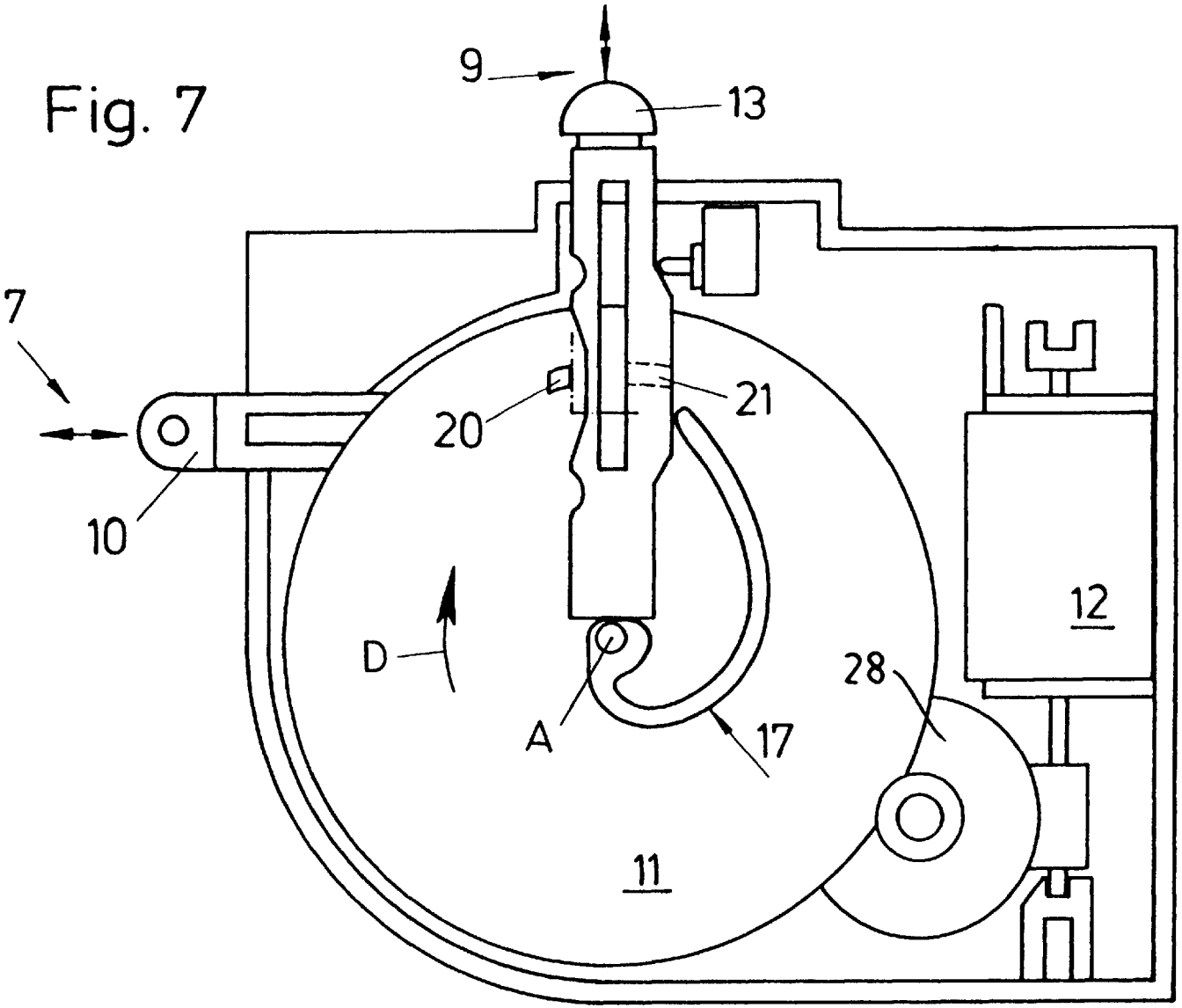

FIGS. 6 and 7 show an arrangement where structure functionally identical to that of FIGS. 1 through 4 has the same reference characters. Here the motor 12 operates the cam disk 11 through a stepdown transmission 28 and is laterally offset from this structure. The cam disk 11 carries on one face a cam formation 16 that operates the latch actuator 10 and on its opposite face a cam formation 17 that operates the pusher 13. The cam formation 16 has a starting portion 19 that extends basically radially of the cam 11 and a trailing portion 18 that is circularly concentric with the cam 11 and the cam formation 17 is basically spiral shaped.

Thus when the cam 11 starts to rotate in the direction D, the portion 19 first pushes out the element 10 to unlatch the latch 3, and then the portion 18 holds the latch open. The spiral cam 17 is positioned so that it pushes up the pusher 9 to force the lid 2 open after the latch is unlatched. The cam formation 16 holds the latch 3 in the unlatched position until the cam formation 17 has raised the lid 2. An abutment projection 20 on the cam 11 can pass through a notch 21 in the pusher 9 only in its down position corresponding to a closed position of the trunk lid 2, but otherwise engages the side of this pusher 9. Thus to start with the abutment 20 will pass through the notch 21 and allow the cam 11 to rotate, but after the lid 2 is raised, this abutment 20 will engage the side of the pusher 9 and stop the cam 11, ending the cycle which can only be restarted with the pusher 9 is forced back down, that is when the lid 2 is closed.

We claim:

1. In combination with a motor-vehicle trunk lid that is movable between an open position and a closed position, a latch system comprising:

a latch engageable with the lid and having a control element movable between a latched position in which the latch retains the lid in the closed position and an unlatched position in which it allows the lid to move from the closed to the open position;

a pusher engageable with the lid and displaceable between a down position with the lid in the closed position and an up position forcing the lid into the open position;

a drive motor having a cam rotatable about an axis and having a cam formation engageable with the control element and with the pusher and displaceable through a first position moving the control element into the unlatched position and a second position moving the pusher into the up position; and remote control means for operating the drive motor and displacing the cam formation sequentially through the first and second positions.

2. The motor-vehicle trunk-lid latch system defined in claim 1 wherein the pusher is coupled to the lid such that when the lid is returned to the closed position the pusher is moved back to the down position.

3. The motor-vehicle trunk-lid latch system defined in claim 1 wherein the first and second positions are angularly offset by about 90° from each other.

4. The motor-vehicle trunk-lid latch system defined in claim 1 wherein the pusher includes an abutment engageable in the up position of the pusher with the cam to prevent its rotation past a third position angularly offset from the first and second positions, the abutment being clear of the cam in the down position of the pusher.

5. The motor-vehicle trunk-lid latch system defined in claim 1 wherein the cam is provided with a first cam formation engageable with the latch control element and a separate second cam formation engageable with the pusher.

6. The motor-vehicle trunk-lid latch system defined in claim 5 wherein the cam is a disk having one face carrying the first formation and an opposite face carrying the second formation.

7. The motor-vehicle trunk-lid latch system defined in claim 5 wherein the first formation has a generally radially extending starting portion and a following portion of generally part-circular shape centered on the axis.

8. The motor-vehicle trunk-lid latch system defined in claim 7 wherein the second formation is generally spiral shaped and is angularly set relative to the first formation so as to raise the pusher into the up position only after the latch control element has been moved to the unlatched position.

9. The motor-vehicle trunk-lid latch system defined in claim 5 wherein the motor has an output shaft carrying the cam.

10. The motor-vehicle trunk-lid latch system defined in claim 5, further comprising a transmission between the motor and the cam.

* * * * *